US012606330B2

(12) United States Patent
De Ridder et al.

(10) Patent No.: US 12,606,330 B2
(45) Date of Patent: Apr. 21, 2026

(54) PACKAGING SYSTEM FOR PRODUCING POUCHES COMPRISING A WATER-SOLUBLE FOIL AND A POWDER

(71) Applicant: EME ENGEL MACHINEFABRIEK EN ENGINEERING B.V., Zaandam (NL)

(72) Inventors: Freek Willem Laurens De Ridder, Naarden (NL); Maickel Nuij, Dronten (NL)

(73) Assignee: EME ENGEL MACHINEFABRIEK EN ENGINEERING B.V., Zaandam (NL)

( * ) Notice: Subject to any disclaimer, the term of this patent is extended or adjusted under 35 U.S.C. 154(b) by 45 days.

(21) Appl. No.: 18/847,949

(22) PCT Filed: Mar. 16, 2023

(86) PCT No.: PCT/EP2023/056734
§ 371 (c)(1),
(2) Date: Sep. 17, 2024

(87) PCT Pub. No.: WO2023/175067
PCT Pub. Date: Sep. 21, 2023

(65) Prior Publication Data

US 2026/0048879 A1 Feb. 19, 2026

(30) Foreign Application Priority Data

Mar. 18, 2022 (NL) ..... 2031324

(51) Int. Cl.
*B65B 9/04* (2006.01)
*B65B 1/02* (2006.01)
(Continued)

(52) U.S. Cl.
CPC ..... *B65B 1/02* (2013.01); *B65B 1/06* (2013.01); *B65B 9/042* (2013.01); *B65B 39/00* (2013.01); *B65B 2039/009* (2013.01)

(58) Field of Classification Search
CPC ... B65B 37/02; B65B 2039/009; B65B 39/00; B65B 39/003; B65B 9/042; B65B 1/02; B65B 1/06; B65D 65/46
See application file for complete search history.

(56) References Cited

U.S. PATENT DOCUMENTS 2,690,827 A * 10/1954 Wiggins ..... B65B 39/00 141/34
3,218,776 A * 11/1965 Cloud ..... B65B 47/10 53/546

(Continued)

FOREIGN PATENT DOCUMENTS

EP 0099238 A2 1/1984
EP 0074846 B1 12/1985
EP 3460423 A1 3/2019

OTHER PUBLICATIONS

Netherlands Search Report and Written Opinion dated Nov. 23, 2022, for Netherlands Application No. 2031324.

(Continued)

*Primary Examiner* — Andrew M Tecco
(74) *Attorney, Agent, or Firm* — Patterson + Sheridan, LLP

(57) ABSTRACT

Packaging system (1) for producing pouches comprising a water-soluble foil (3) and a powder, wherein the packaging system comprises multiple moulds (5) and a mould conveyor (8), wherein the moulds (5) are moved along a foil supplying device (50), a compartment forming device (12), a powder filling device (13), and wherein the powder filling device (13) comprises a powder supply (14) and a powder distribution unit (15).

20 Claims, 16 Drawing Sheets

Figure 1:
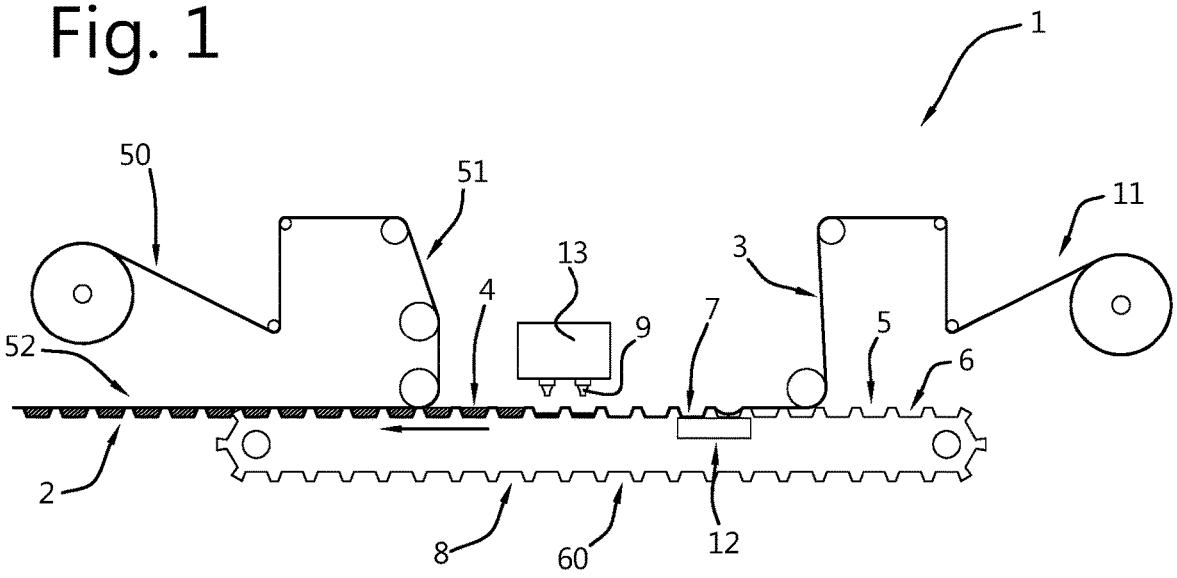

(51) Int. Cl.
*B65B 1/06* (2006.01)
*B65B 39/00* (2006.01)

(56) References Cited

U.S. PATENT DOCUMENTS

| | | | | | |
|---|---|---|---|---|---|
| 4,465,150 | A * | 8/1984 | Matsumoto | B65B 37/16 | 141/106 |
| 4,553,617 | A * | 11/1985 | Tatematsu | B65B 1/06 | 141/238 |
| 5,236,021 | A * | 8/1993 | Bewlay | B65B 39/00 | 141/34 |
| 10,702,894 | B2 * | 7/2020 | Brandt Sanz | B08B 5/043 | |
| 10,723,492 | B2 * | 7/2020 | Kieselhorst | B65B 39/12 | |
| 11,225,348 | B2 * | 1/2022 | Brandt Sanz | B65D 65/46 | |
| 11,878,829 | B2 * | 1/2024 | McLenithan | B65B 39/14 | |
| 2014/0124990 | A1 * | 5/2014 | Fowler | B65B 55/24 | 264/571 |
| 2017/0088298 | A1 * | 3/2017 | McLenithan | B65B 61/06 | |
| 2018/0290774 | A1 * | 10/2018 | Fowler | B65B 9/042 | |
| 2019/0084700 | A1 * | 3/2019 | Kieselhorst | B65B 37/16 | |
| 2021/0229842 | A1 * | 7/2021 | McLenithan | B65D 65/46 | |

OTHER PUBLICATIONS

PCT International Search Report and Written Opinion dated Jul. 5, 2023, for International Application No. PCT/EP2023/056734.
PCT International Preliminary Report on Patentability dated Jul. 9, 2024, for PCT/EP2023/056734.

* cited by examiner

PACKAGING SYSTEM FOR PRODUCING POUCHES COMPRISING A WATER-SOLUBLE FOIL AND A POWDER

FIELD OF THE INVENTION

The invention relates to a packaging system for producing pouches comprising a water-soluble foil and a powder. More specifically, the packaging system may be used for producing pouches containing a detergent powder.

BACKGROUND OF THE INVENTION

The known packaging system has the disadvantage that the produced pouches differ from each other.

The invention is based on the insight that there is a need in the field of the art for a packing system which produces pouches having no differences, or at least a reduced degree of differences.

SUMMARY OF THE INVENTION

The invention has the objective to provide an improved, or at least alternative, packaging system for producing pouches comprising a water-soluble foil and a powder.

This objective is achieved by a packaging system for producing pouches comprising a water-soluble foil and a powder. Said packaging system comprises:

- multiple moulds, each mould having a mould cavity for forming a compartment in the foil, and
- a mould conveyor configured to move the moulds in a conveying direction along a mould trajectory, such as an endless mould trajectory, and wherein the moulds are moved along:
- a foil supplying device configured to position the foil on the moulds,
- a compartment forming device configured to position parts of the foil in the mould cavities to form the compartments in the foil,
- a powder filling device comprising multiple powder dispensers configured to fill the compartments with the powder, and wherein
- the powder filling device comprises a powder supply for supplying the powder to a powder distribution unit which distributes the powder over multiple powder channels which are in fluid communication with the powder dispensers,
- the powder distribution unit comprises a powder distributor comprising a distributor discharging opening which is positioned along a distribution path,
- each powder channel comprises a channel receiving opening,
- the channel receiving openings are positioned along the distribution path and directed towards the distributor discharging opening to receive powder discharged from the distributor discharging opening, and
- the packaging system comprises a distribution drive configured to move the distributor discharging opening and the channel receiving openings relative to each other with a cyclical movement along the distribution path to supply powder from the powder distributor to the powder channels.

Powders contain particles which up to a certain extent differ from each other with respect to the particle size and/or the volumetric mass density and/or the particle shape. Detergent powders contain particles made from different components due to which detergent powders tend to have a relatively high degree of differences between the particles.

In a packaging system for producing pouches comprising a water-soluble foil and a powder, the powder in the powder stream of the powder supply is subjected to segregation. For example, larger particles tend to behave differently in the powder stream than smaller particles, and the same applies to heavier and lighter particles. As a result, the powder channels of known packaging systems tend to receive powder with a different composition of the particles when the powder supply is split over the powder channels. The dispensers in fluid communication with these powder channels will therefore fill the compartments of the pouches with powders having a different composition of the particles. This leads to pouches having a relatively high degree of differences with respect to the powder in the pouches.

Especially for detergent powders it is essential that the powder in the pouches have no differences, or a relatively low degree of differences, with respect to the powder in the pouches in order to ensure that each pouch achieves a good cleaning effect.

The powder distribution unit of the packaging system according to the invention ensures that the powder channels receive powder having no differences, or at least a relatively low degree of differences, in the composition of the particles of the powder. Hence, the produced pouches have no differences, or at least a relatively low degree of differences.

In an embodiment of the packaging system according to the invention, the distributor discharging opening and the channel receiving openings are configured to overlap along an associated first overlap line extending in a first direction perpendicular to the distribution path in a same manner for each channel receiving opening during said cyclical movement of the distributor discharging opening and the channel receiving openings relative to each other.

In an embodiment of the packaging system according to the invention, each first overlap line has a same first overlap length.

In an embodiment of the packaging system according to the invention, said first overlap line for each channel receiving opening has a same first overlap position in the first direction with respect to the distribution path.

In an embodiment of the packaging system according to the invention, said overlapping along the associated first overlap line for each channel receiving opening is determined in a first situation of maximum overlap along the first overlap line between the distributor discharging opening and the respective channel receiving opening, wherein the first overlap line has a maximum first overlap length in said first situation.

In an embodiment of the packaging system according to the invention, each channel receiving opening extends over a channel length in the first direction and the channel lengths of all the channel receiving openings are equal to each other.

In an embodiment of the packaging system according to the invention, each channel receiving opening has a same channel position in the first direction with respect to the distribution path.

In an embodiment of the packaging system according to the invention, the distributor discharging opening and each of the channel receiving openings are configured to overlap along an associated second overlap line extending in a second direction along the distribution path in a same manner for each channel receiving opening during said cyclical movement of the distributor discharging opening and the channel receiving openings relative to each other.

In an embodiment of the packaging system according to the invention, each second overlap line has a same second overlap length.

In an embodiment of the packaging system according to the invention, said overlapping in the second direction for each channel receiving opening is determined in a second situation of maximum overlap along the second overlap line between the distributor discharging opening and the respective channel receiving opening, wherein the second overlap line has a maximum second overlap length in said second situation.

In an embodiment of the packaging system according to the invention, each channel receiving opening extends over a channel width in the second direction and the channel widths of all the channel receiving openings are equal to each other.

In an embodiment of the packaging system according to the invention, each channel receiving opening has a receiving shape, wherein the receiving shapes of all channel receiving openings are equal to each other.

In an embodiment of the packaging system according to the invention, the distribution drive is configured to move the distributor discharging opening and the channel receiving openings relative to each other at a constant speed.

In an embodiment of the packaging system according to the invention, the distributor discharging opening passes each of the channel receiving openings at a constant speed during said cyclical movement of the distributor discharging opening and the channel receiving openings relative to each other.

In an embodiment of the packaging system according to the invention, the distribution drive is configured to move the distributor discharging opening and the channel receiving openings relative to each other with a continuous movement.

In an embodiment of the packaging system according to the invention, the distributor discharging opening passes each of the channel receiving openings with a continuous movement during said cyclical movement of the distributor discharging opening and the channel receiving openings relative to each other.

In an embodiment of the packaging system according to the invention, the distribution drive is configured to move the powder distributor in order to create said cyclical movement of the distributor discharging opening and the channel receiving openings relative to each other. This embodiment may be free from actively moving the powder channels.

In an embodiment of the packaging system according to the invention, the distribution drive is configured to move the powder channels in order to create said cyclical movement of the distributor discharging opening and the channel receiving openings relative to each other. This embodiment may be free from actively moving the distributor discharging opening.

In an embodiment of the packaging system according to the invention, the distribution drive is configured to move the powder distributor and the powder channels in order to create said cyclical movement of the distributor discharging opening and the channel receiving openings relative to each other.

In an embodiment of the packaging system according to the invention, the distribution drive is configured to move the distributor discharging opening of the distributor along a distributor trajectory extending parallel to the distribution path.

In an embodiment of the packaging system according to the invention, the distribution drive is configured to move distributor discharging opening of the distributor along a channel trajectory extending parallel to the distribution path.

In an embodiment of the packaging system according to the invention, the distribution path is a closed path, such as a circular path, and wherein optionally the cyclical movement is a cyclical continuous movement or a cyclical back and forth movement.

In an embodiment of the packaging system according to the invention, the distribution path is an open-ended path, such as a straight path, and wherein optionally the cyclical movement is a cyclical back and forth movement.

In an embodiment of the packaging system according to the invention, the distribution path extends between a first end position and a second end position, wherein the distributor discharging opening is free from fluid communication with any of the channel receiving openings when the distributor discharging opening is positioned at the first end position and/or the second end position.

In an embodiment of the packaging system according to the invention, the distribution drive, the first end position and the second end position are configured to allow the powder distributor to accelerate in order to move the distributor discharging opening and the channel receiving openings relative to each other at a constant speed.

In an embodiment of the packaging system according to the invention, the distribution path comprises at least one parking section which is free from channel receiving openings to allow parking of the powder distributor without discharging powder in any of the channel receiving openings.

In an embodiment of the packaging system according to the invention, the parking section comprises a powder collecting unit configured to collect powder discharged by the powder distributor.

In an embodiment of the packaging system according to the invention, the parking section comprises a stop surface configured to stop powder flow from the distributor discharging opening.

In an embodiment of the packaging system according to the invention, the powder distributor supplies powder to all the powder channels during the cyclical movement of the distributor discharging opening and the channel receiving openings relative to each other.

In an embodiment of the packaging system according to the invention, the powder distributor supplies powder to each of the powder channels during the cyclical movement of the distributor discharging opening and the channel receiving openings relative to each other.

In an embodiment of the packaging system according to the invention, the distributor discharging opening passes each of the channel receiving openings during said cyclical movement of the distributor discharging opening and the channel receiving openings relative to each other.

In an embodiment of the packaging system according to the invention, the distributor discharging opening passes all the channel receiving openings during said cyclical movement of the distributor discharging opening and the channel receiving openings relative to each other.

In an embodiment of the packaging system according to the invention, the distributor discharging opening overlaps each of the channel receiving openings during said cyclical movement of the distributor discharging opening and the channel receiving openings relative to each other.

In an embodiment of the packaging system according to the invention, the distributor discharging opening overlaps all the channel receiving openings during said cyclical movement of the distributor discharging opening and the channel receiving openings relative to each other.

In an embodiment of the packaging system according to the invention, each powder channel is in fluid communication with only one powder dispenser and each powder dispenser is in fluid communication with only one of the powder channels.

In an embodiment of the packaging system according to the invention, the powder filling device is configured to simultaneously discharge the powder from the powder dispensers in order to fill multiple compartments in the foil at the same time.

In an embodiment of the packaging system according to the invention, the packaging system comprises a further foil supplying device configured to position a water-soluble further foil on the foil and over the powder in the compartments in order to form a web of pouches holding the powder between the foil and the further foil.

In an embodiment of the packaging system according to the invention, the powder distribution unit comprises at least one powder distributor, the distributor discharging opening of each of the at least one powder distributor is positioned along the distribution path, and the distribution drive is configured to move the distributor discharging opening of each of the at least one powder distributor and the channel receiving openings relative to each other with the cyclical movement along the distribution path to supply powder from each of the at least one powder distributor to all of the powder channels, and/or the distribution drive is configured to move the distributor discharging opening of each of the at least one powder distributor and the channel receiving openings relative to each other with the cyclical movement along the distribution path to supply powder from each of the at least one powder distributor to each of the powder channels.

In an embodiment of the packaging system according to the invention, the powder distribution unit comprises only one powder distributor.

In an embodiment of the packaging system according to the invention, the packaging system comprises the features of any combination of any number of the above defined embodiments of the packaging system.

The invention further relates to a method for producing pouches comprising a water-soluble foil and powder with the packaging system according to the invention, said method comprising moving the distributor discharging opening of the powder distributor and the channel receiving openings of the powder channels relative to each other with a cyclical movement along the distribution path to supply powder from the powder distributor to the powder channels.

BRIEF DESCRIPTION OF THE INVENTION

Figure 2:
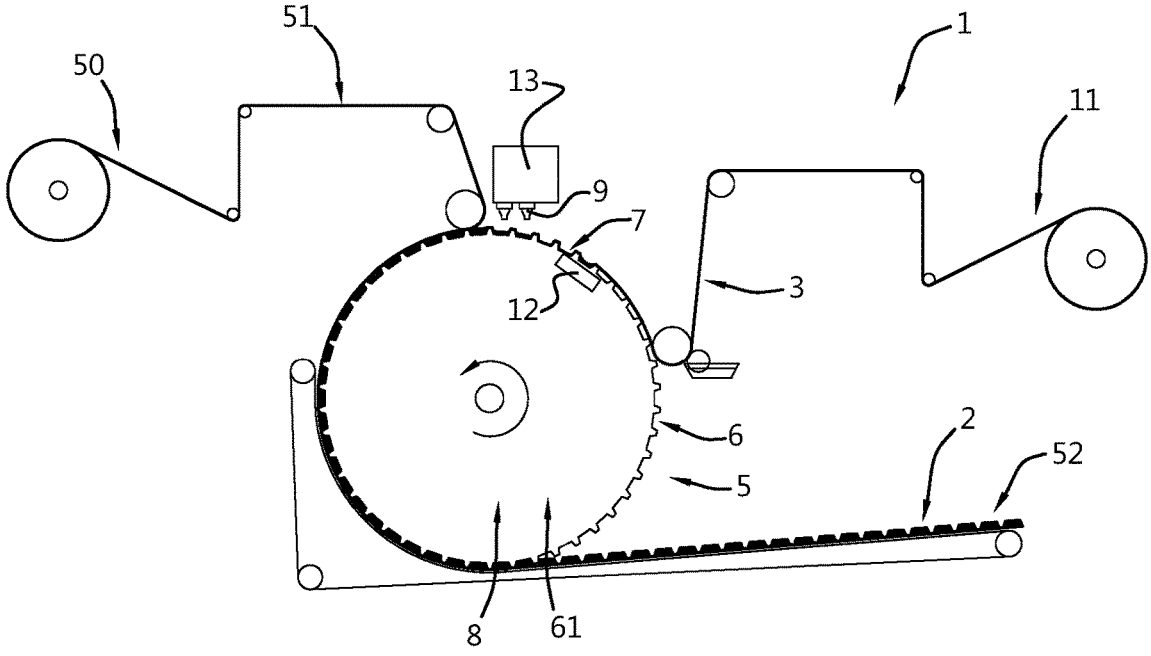
Figure 3:
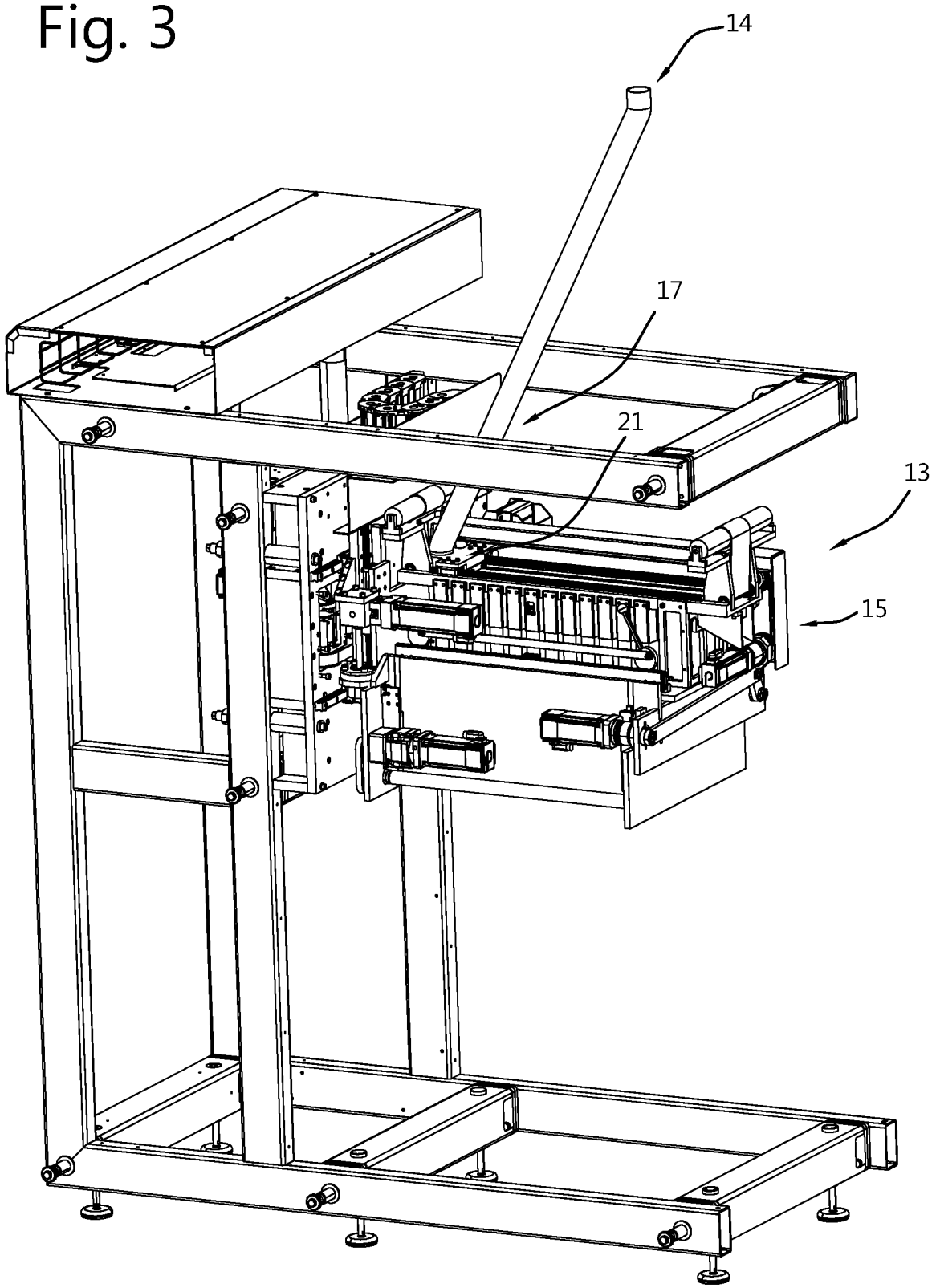
Figure 4:
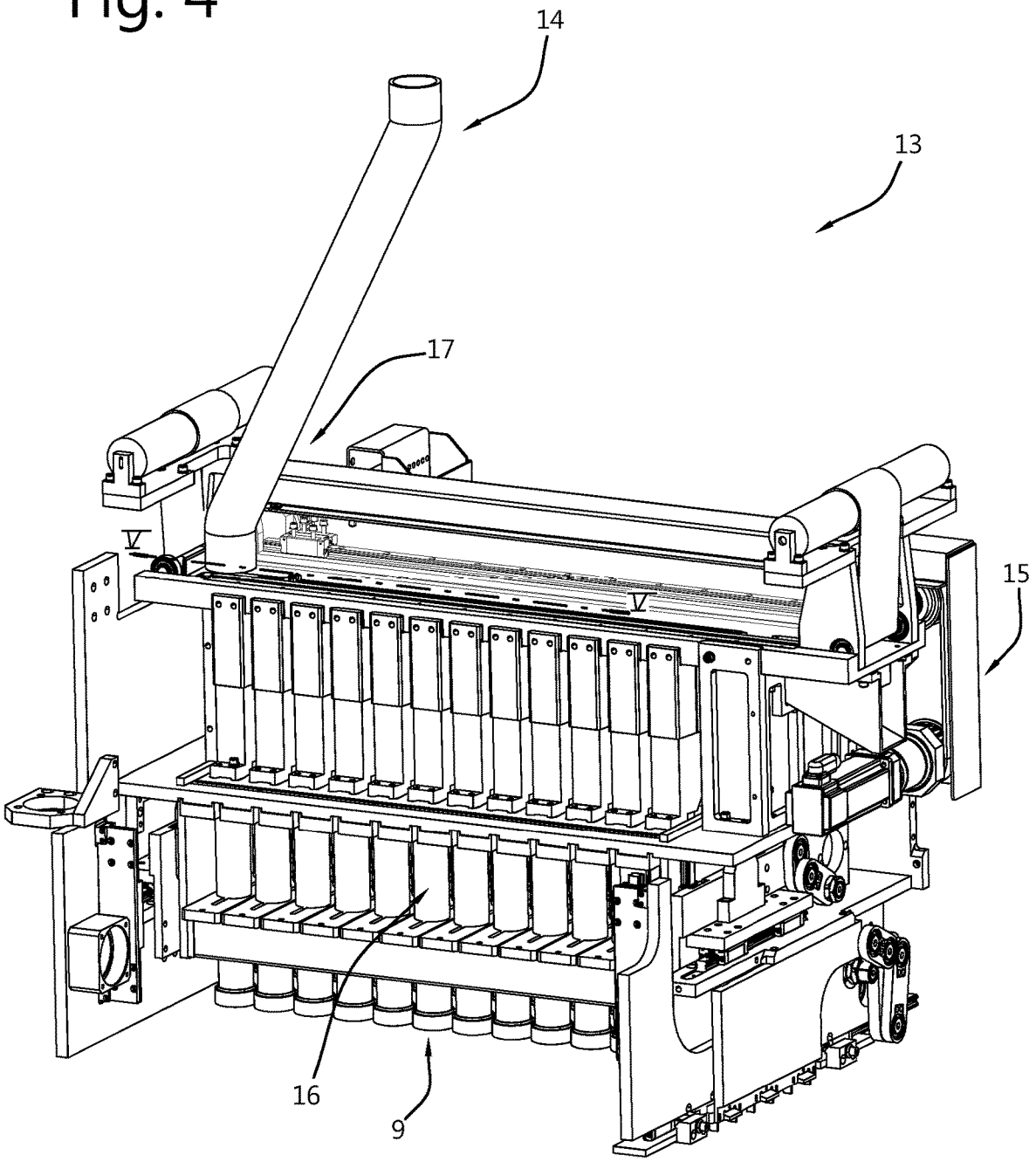
Figure 5:
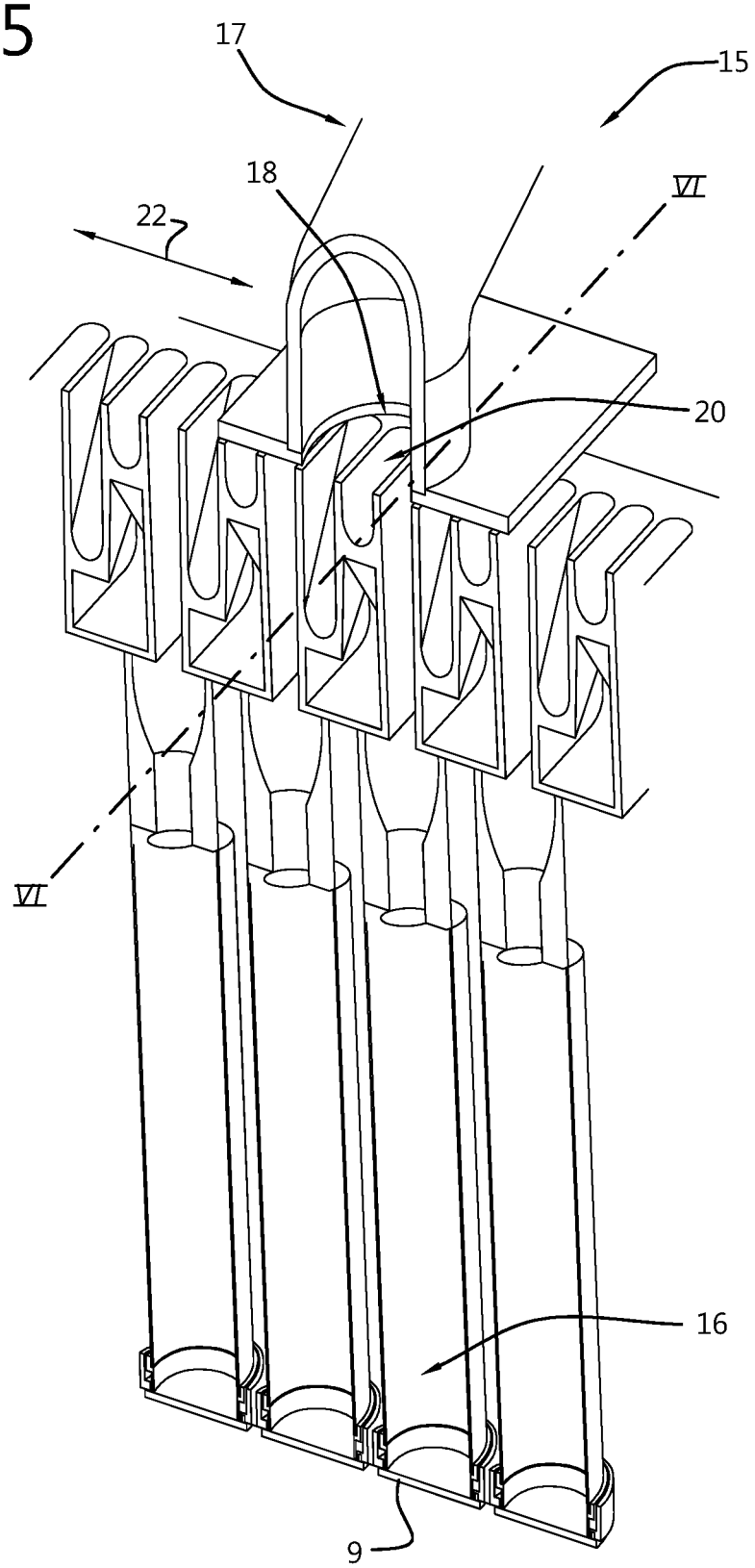
Figure 6:
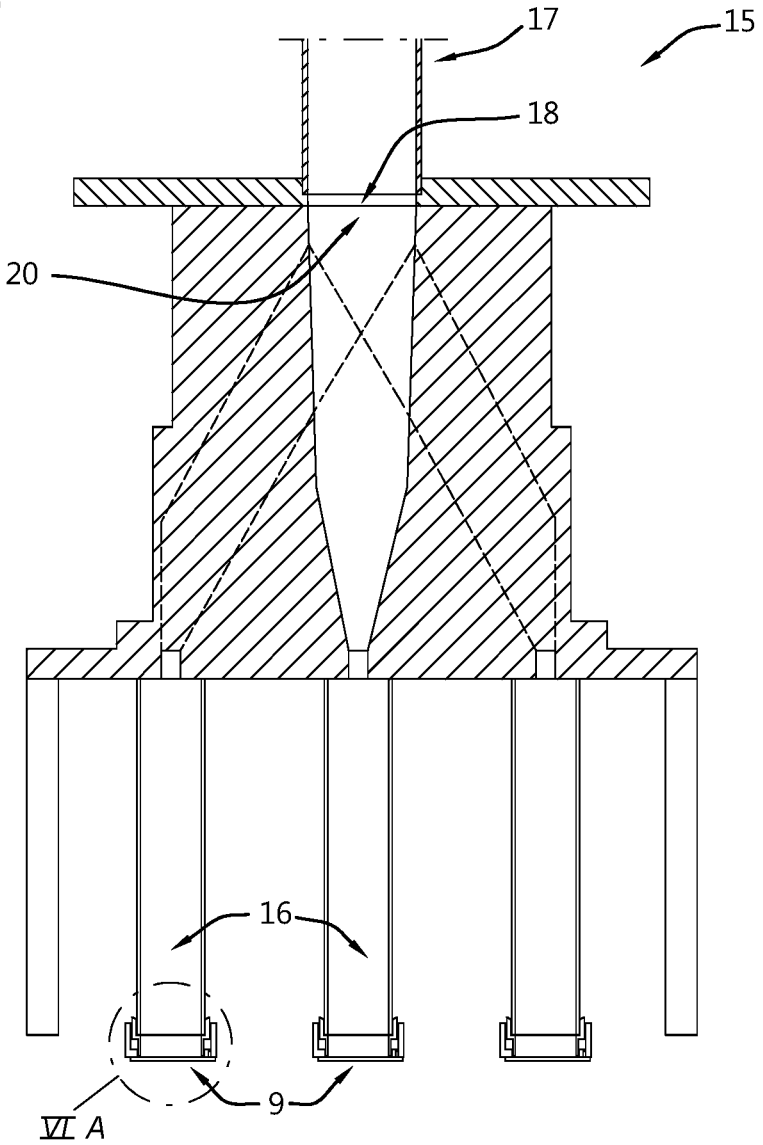
Figure 6A:
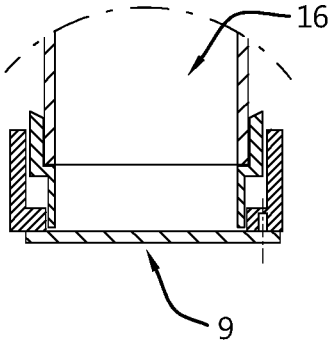
Figure 6B:
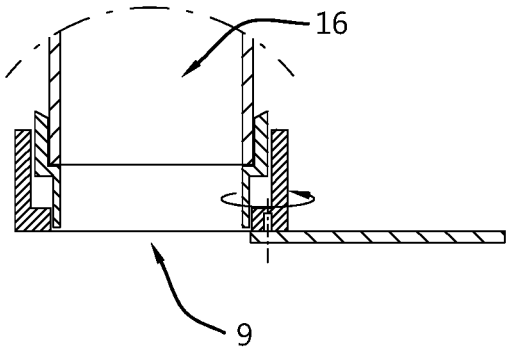
Figure 7A:
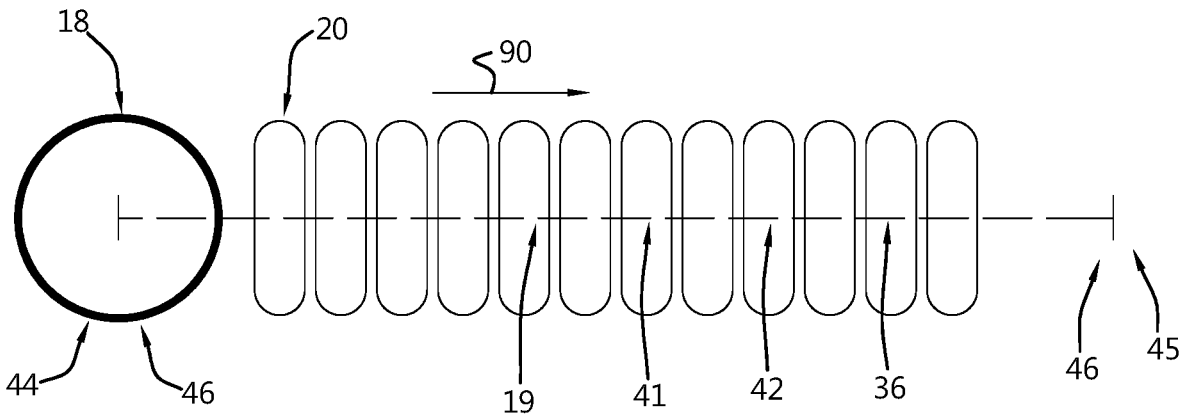
Figure 7B:
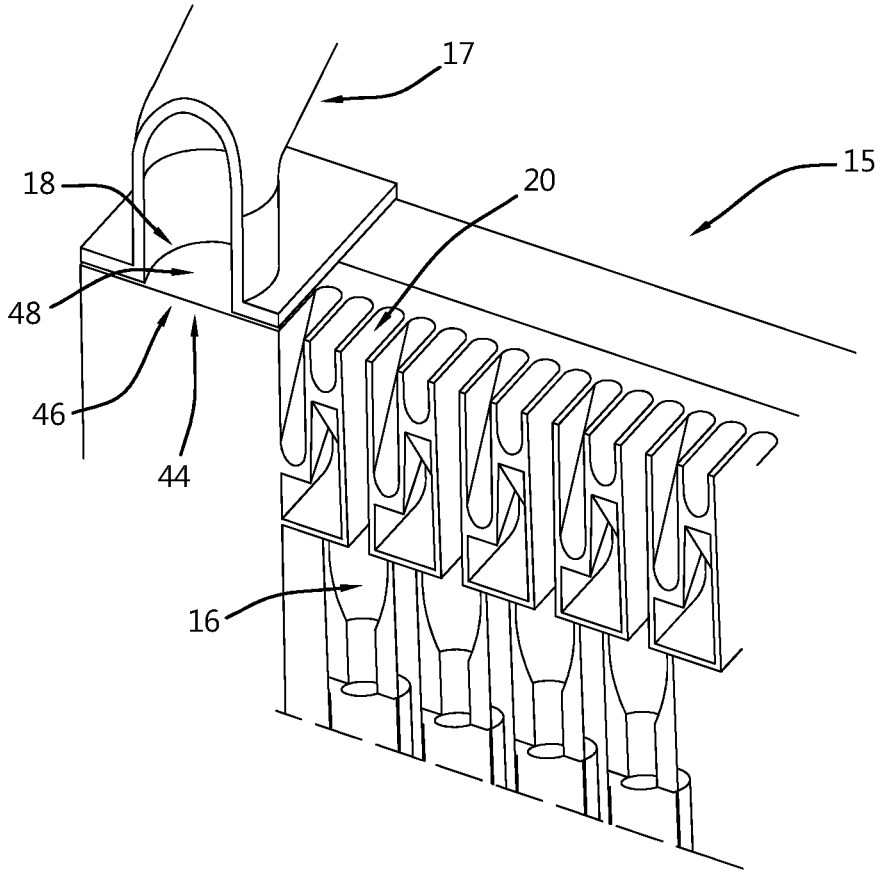
Figure 7C:
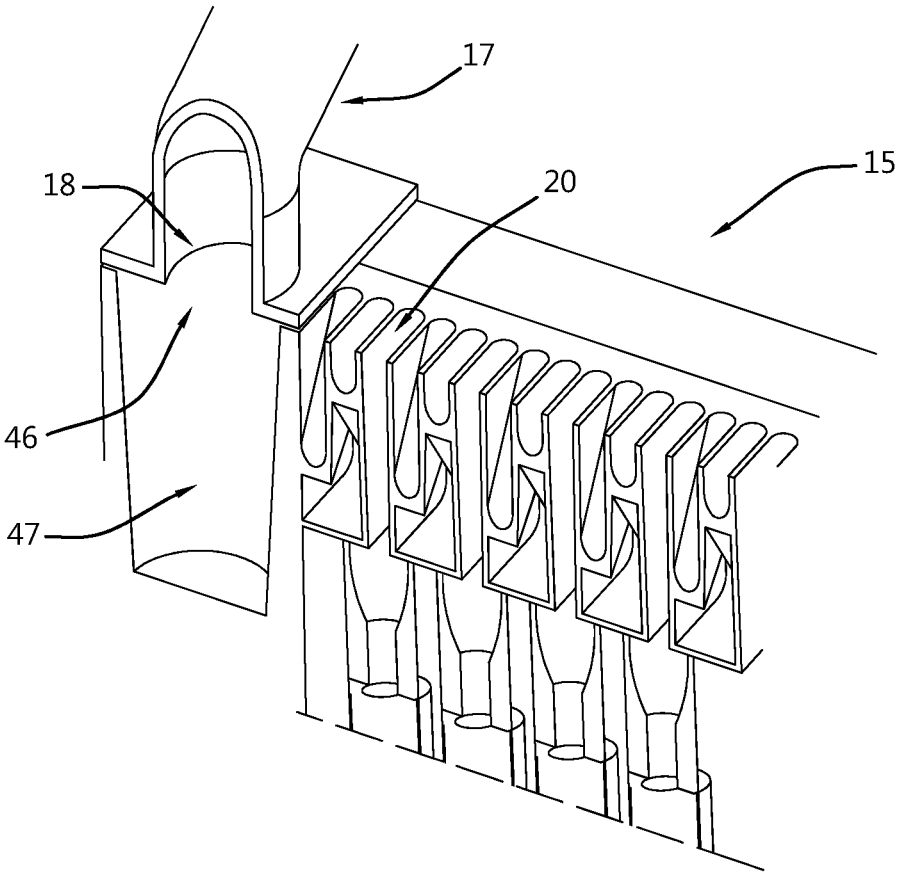
Figure 8A:
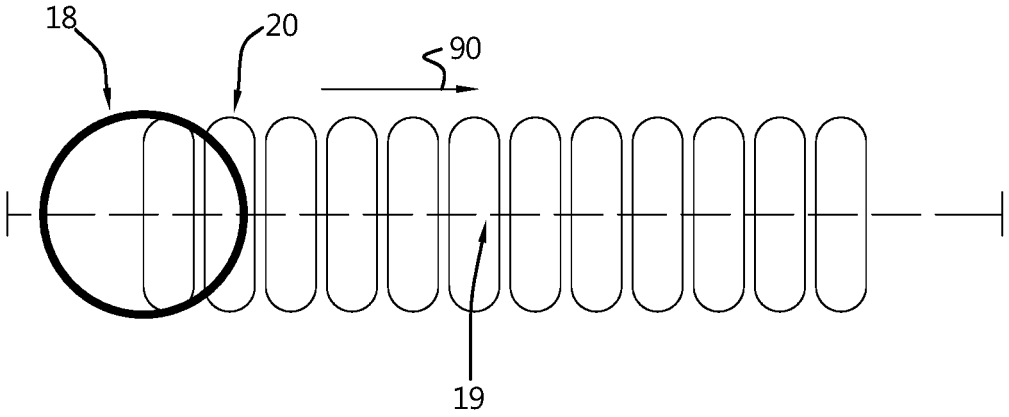
Figure 8B:
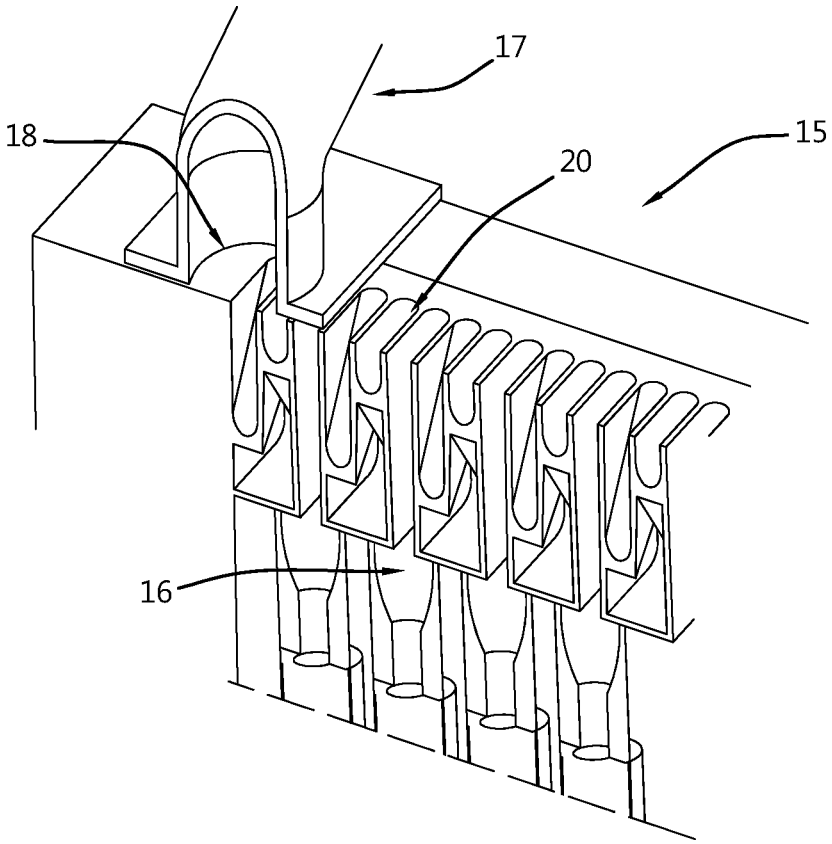
Figure 9A:
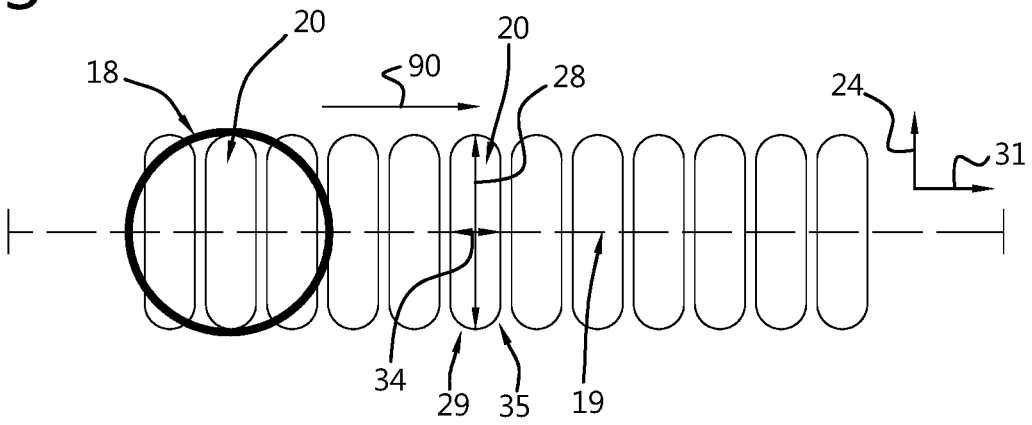
Figure 9B:
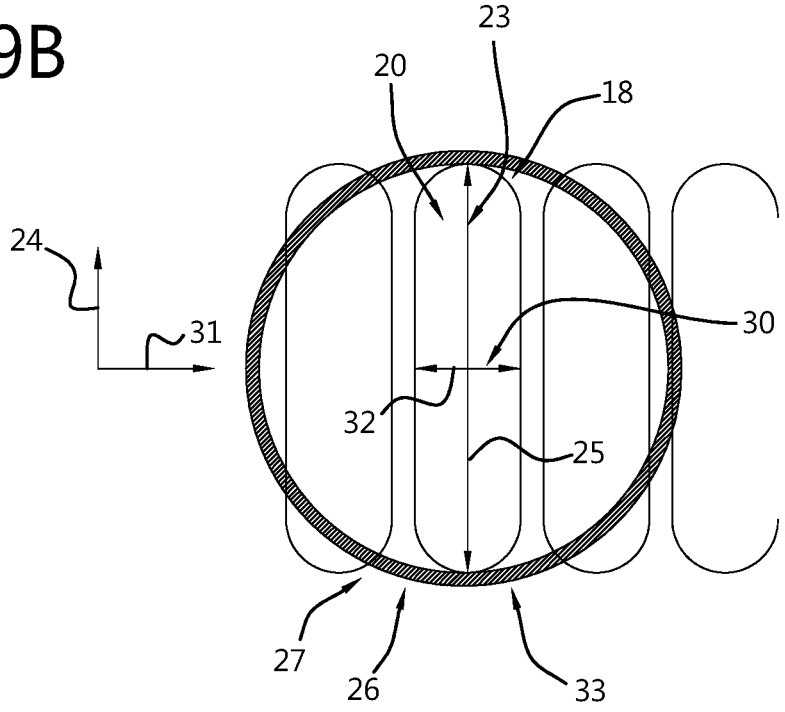
Figure 9C:
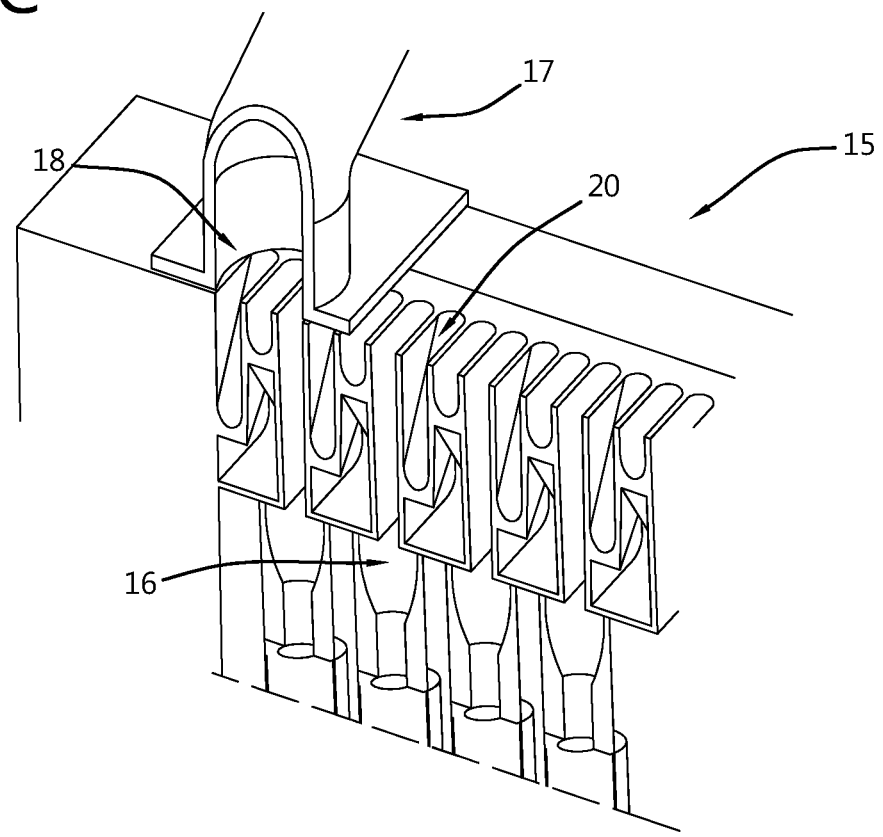
Figure 10A:
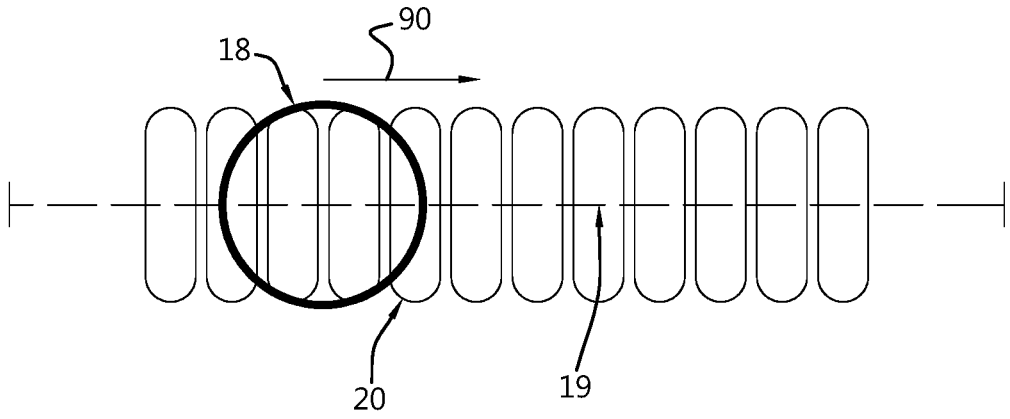
Figure 10B:
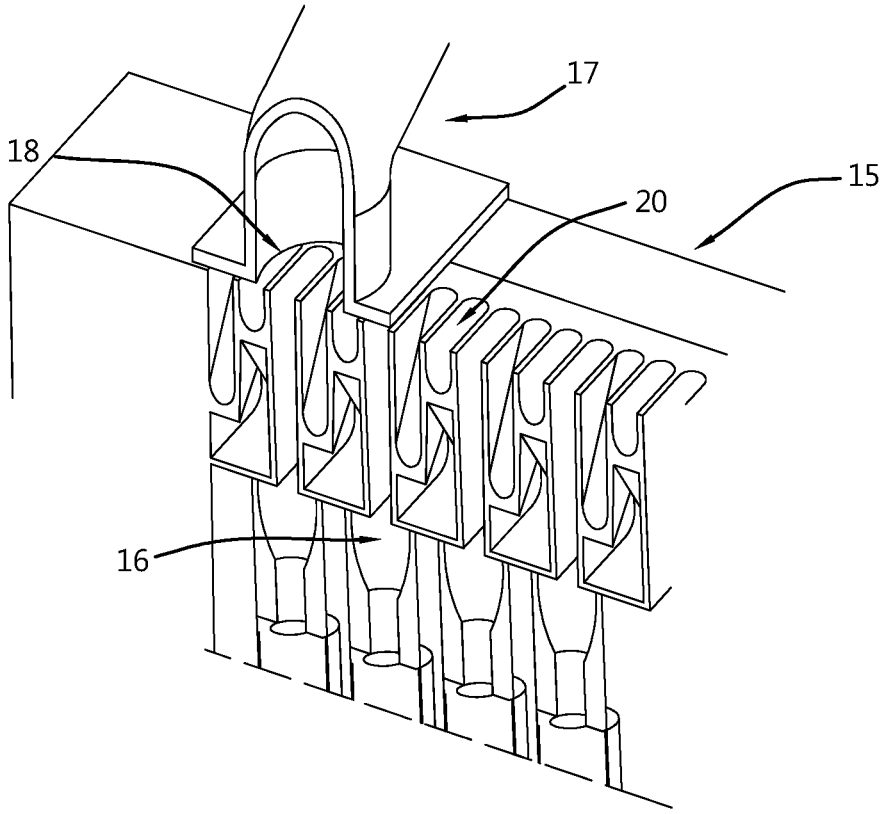
Figure 11A:
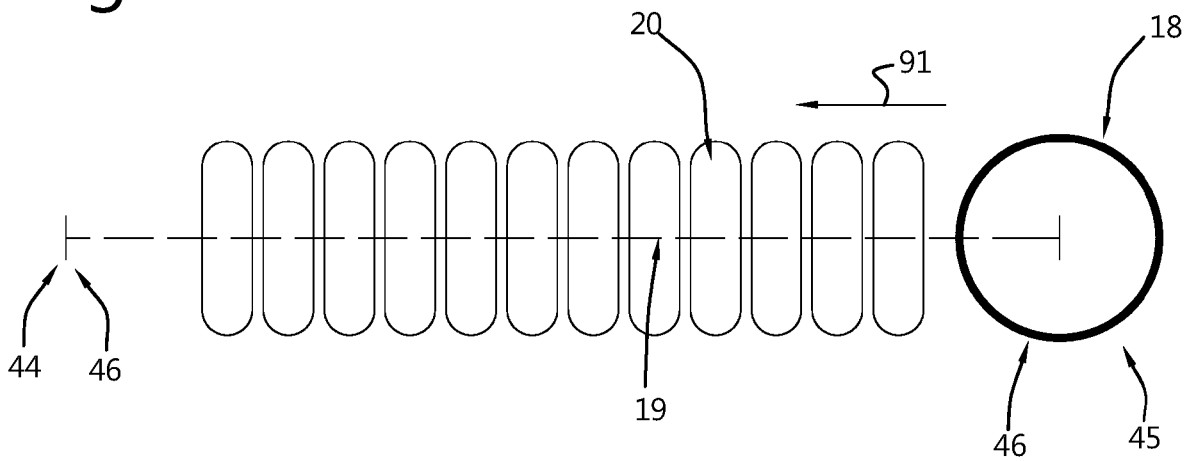
Figure 11B:
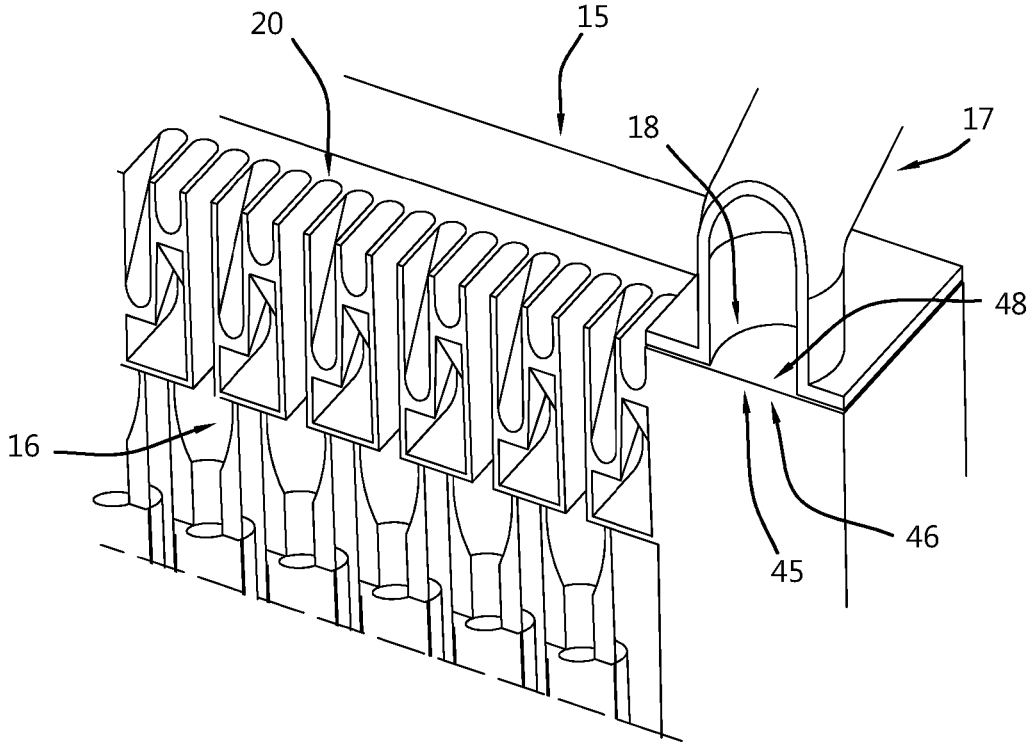
Figure 12A:
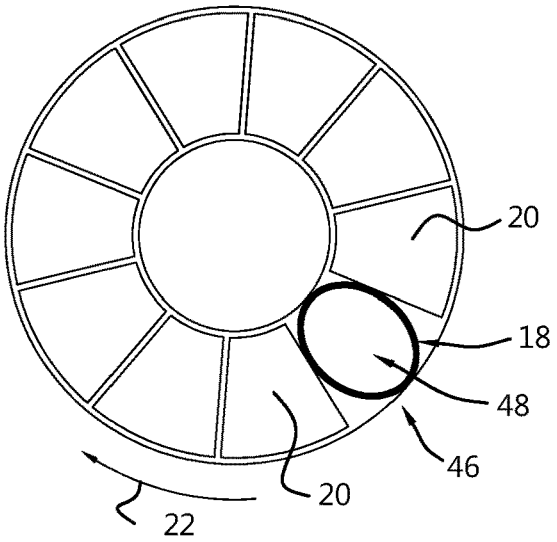
Figure 12B:
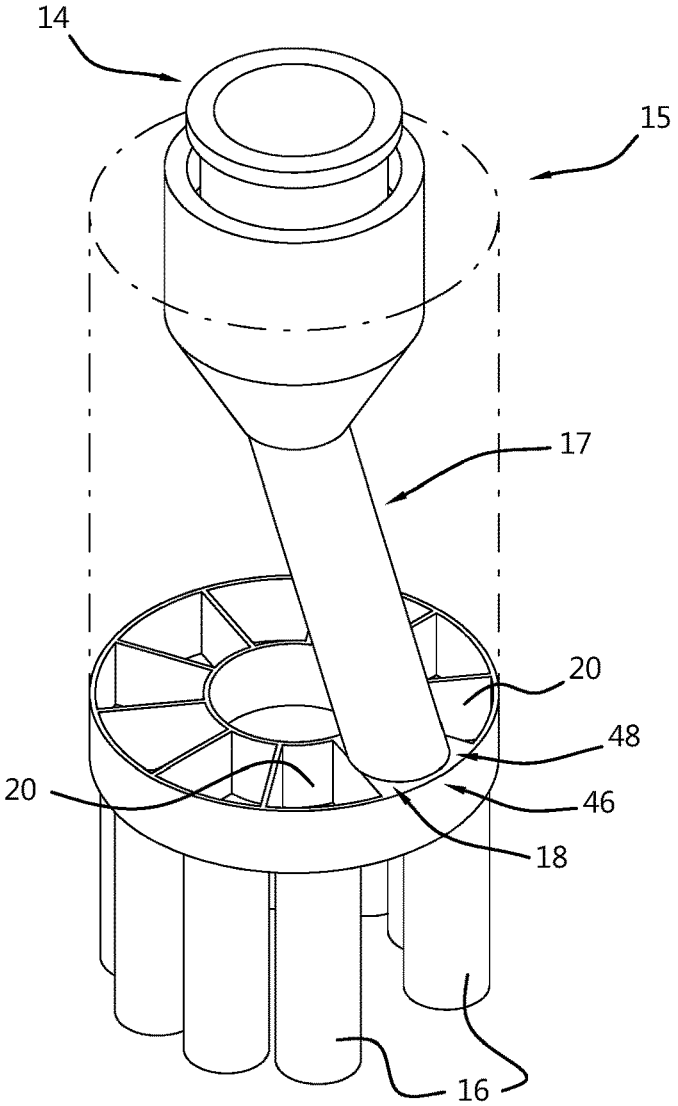
Figure 13A:
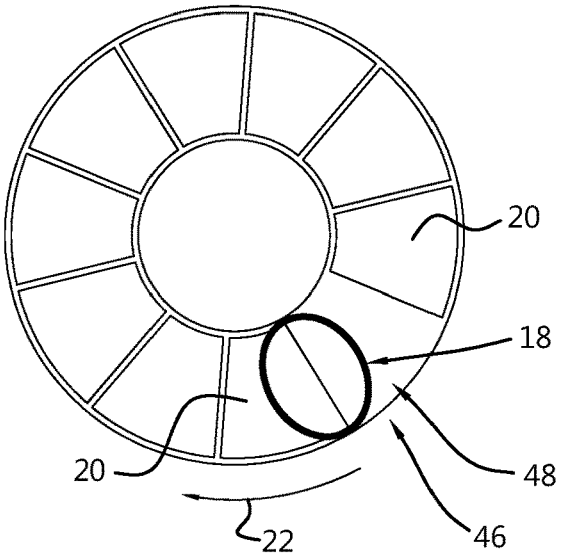
Figure 13B:
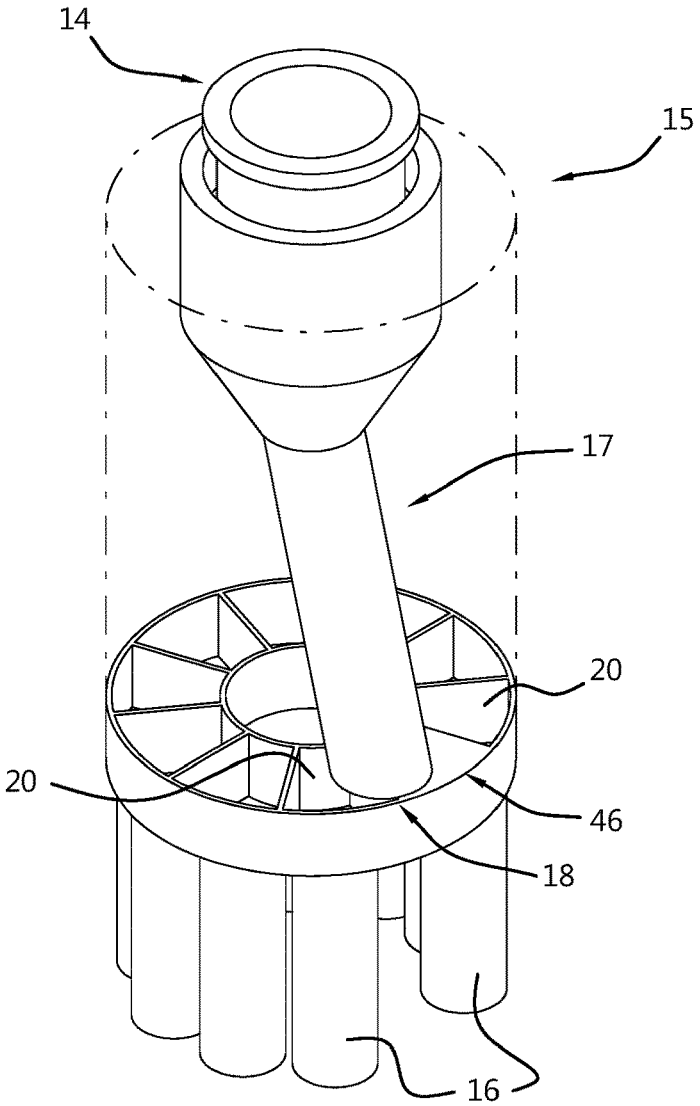
Figure 14A:
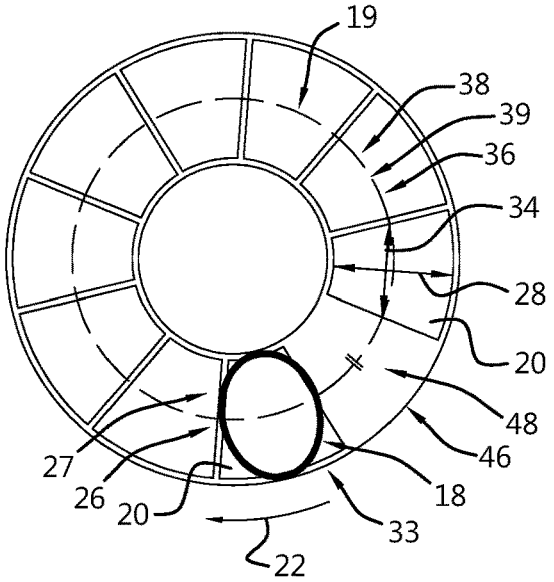
Figure 14B:
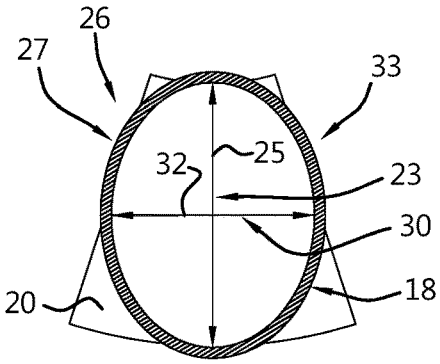
Figure 14C:
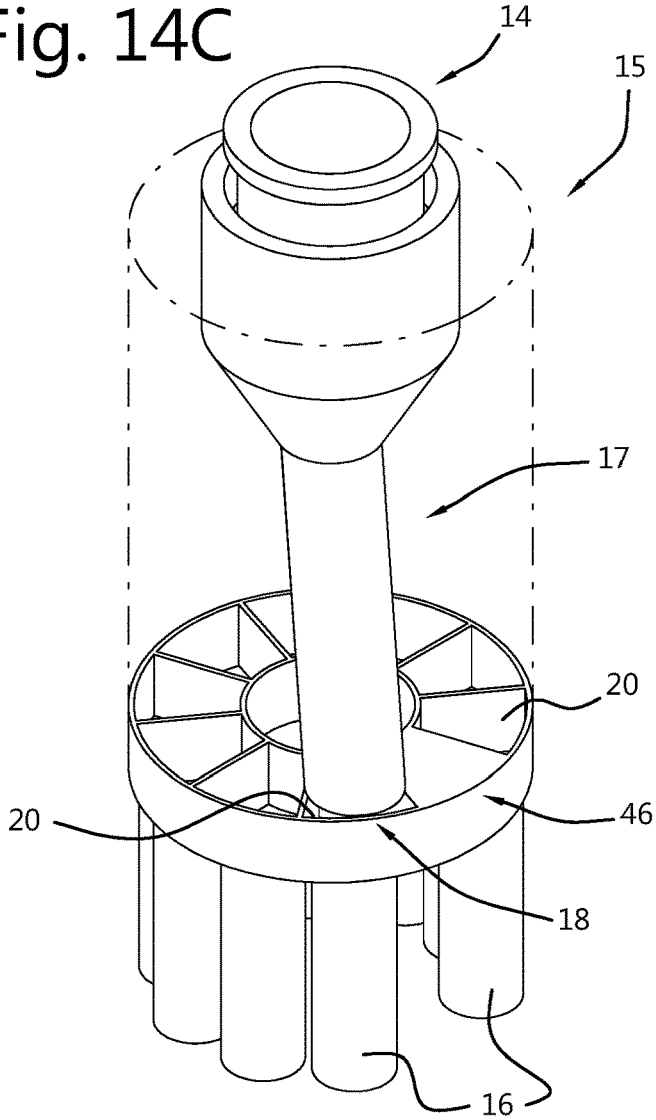
Figure 15A:
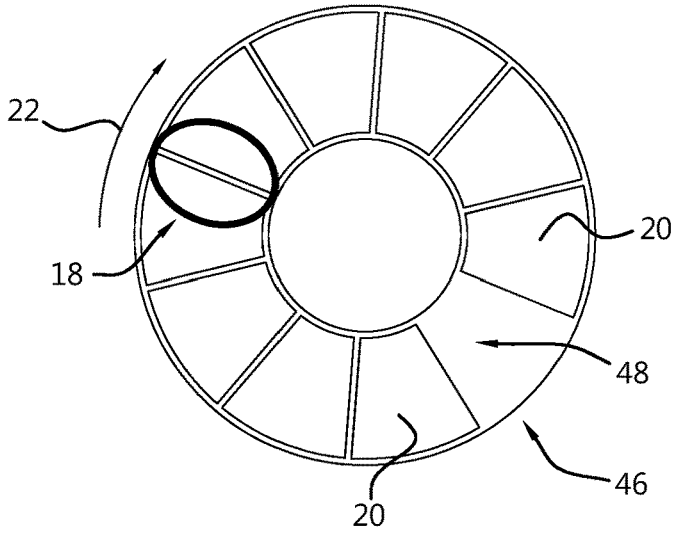
Figure 15B:
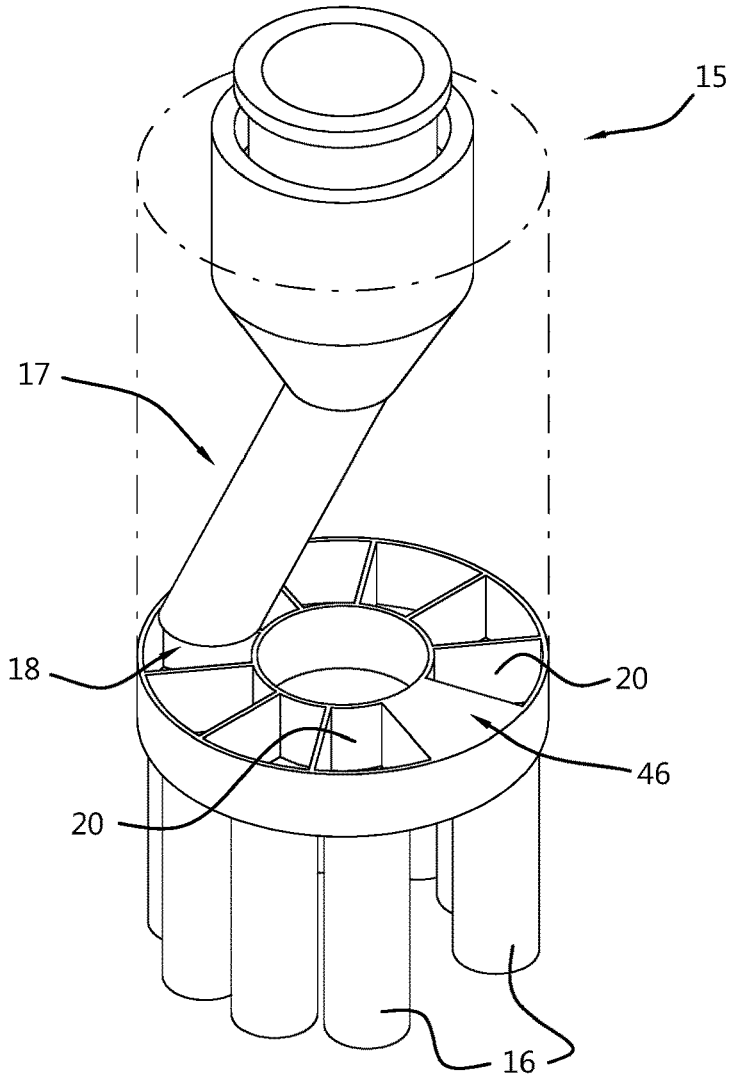

Embodiments of the packaging system according to invention and the method according to the invention will be described by way of example only, with reference to the accompanying schematic drawings in which corresponding reference symbols indicate corresponding parts, and in which:

FIG. 1 schematically shows an overview of a first example of the packaging system according to the invention, FIG. 2 schematically shows an overview of a second example of the packaging system according to the invention, the FIGS. 3 and 4 schematically show a view in perspective of an embodiment of the powder filling device of the packaging system of the FIGS. 1 and 2, FIG. 5 schematically shows a view in cross section along line V-V of FIG. 4, FIG. 6 schematically shows a view in cross section along line VI-VI of FIG. 5, FIG. 6A schematically shows an enlarged view of section VI-A of FIG. 6, wherein the powder dispensers are closed, FIG. 6B schematically shows the view of FIG. 6A, wherein the powder dispensers are open, FIG. 7A schematically shows a simplified top view of the distributor discharging opening and the channel receiving openings of the powder distribution unit of the powder filling device of FIG. 3, wherein the powder distribution unit is positioned in a first position, FIG. 7B schematically shows a view in cross section similar to FIG. 5 and representing the situation of FIG. 7A, FIG. 7C schematically shows an alternative embodiment of the powder distribution unit of FIG. 7B, FIG. 8A schematically shows a top view similar as FIG. 7A, wherein the powder distribution unit is positioned in a second position, FIG. 8B schematically shows a view in cross section similar to FIG. 5 and representing the situation of FIG. 8A, FIG. 9A schematically shows a top view similar as FIG. 7A, wherein the powder distribution unit is positioned in a third position, FIG. 9B schematically shows an enlarged view of part of FIG. 9A, FIG. 9C schematically shows a view in cross section similar to FIG. 5 and representing the situation of FIG. 9A, FIG. 10A schematically shows a top view similar as FIG. 7A, wherein the powder distribution unit is positioned in a fourth position, FIG. 10B schematically shows a view in cross section similar to FIG. 5 and representing the situation of FIG. 10A, FIG. 11A schematically shows a top view similar as FIG. 7A, wherein the powder distribution unit is positioned in a fifth position, FIG. 11B schematically shows a view in cross section similar to FIG. 5 and representing the situation of FIG. 11A, FIG. 12A schematically shows a simplified top view of another alternative embodiment of the powder distribution unit according to the invention, wherein the powder distribution unit is position in a first rotation position, FIG. 12B schematically shows a view in perspective of the powder distribution unit of FIG. 12A, FIG. 13A schematically shows a top view similar as FIG. 12A, wherein the powder distribution unit is position in a second rotation position, FIG. 13B schematically shows a view in perspective of the powder distribution unit of FIG. 12A, FIG. 14A schematically shows a top view similar as FIG. 12A, wherein the powder distribution unit is position in a third rotation position, FIG. 14B schematically shows an enlarged view of part of FIG. 14A, FIG. 14C schematically shows a view in perspective of the powder distribution unit of FIG. 14A, FIG. 15A schematically shows a top view similar as FIG. 12A, wherein the powder distribution unit is position in a fourth rotation position, and FIG. 15B schematically shows a view in perspective of the powder distribution unit of FIG. 15A.

DETAILED DESCRIPTION OF THE INVENTION

FIG. 1 shows an overview of a first example of the packaging system 1 according to the invention. The packaging system 1 is configured to produce pouches 2 comprising a water-soluble foil 3 and a powder 4.

The packaging system 1 comprises multiple moulds 5. Each mould 5 has a mould cavity 6 for forming a compartment 7 in the foil 3.

A mould conveyor 8 moves the moulds 5 in a conveying direction along a mould trajectory, more specifically an endless mould trajectory. The mould conveyor 8 is configured as a mould conveyor belt 60.

The moulds 5 are moved along a foil supplying device 11 configured to position the foil 3 on the moulds 5. Subsequently, a compartment forming device 12 positions parts of the foil 3 in the mould cavities 6 to form the compartments 7 in the foil 3. After that, a powder filling device 13 having multiple powder dispensers 9 fills the compartments 7 with the powder 4. A further foil supplying device 50 positions a water-soluble further foil 51 on the foil 3 and over the powder 4 in the compartments 7 in order to form a web 52 of pouches holding the powder between the foil 3 and the further foil 51. The web 52 of pouches can be cut to form individualised pouches 2.

FIG. 2 shows an overview of a second example of the packaging system 1 according to the invention. The main difference with respect to the packaging system 1 of FIG. 1 is that the mould conveyer 8 is configured as a mould rotary drum 61.

FIG. 3 shows a view in perspective of an embodiment of the powder filling device 13 of the packaging system 1 of the FIGS. 1 and 2. Parts have been removed in FIG. 4 in order to obtain an additional view on the inside of the powder filling device 13. The powder filling device 13 comprises a powder supply 14 for supplying the powder 4 to a powder distribution unit 15 which distributes the powder 4 over multiple powder channels 16 which are in fluid communication with the powder dispensers 9.

FIG. 5 shows a view in cross section along line V-V of FIG. 4. FIG. 6 shows a view in cross section along line VI-VI of FIG. 5. The powder distribution unit 15 comprises a powder distributor 17 comprising a distributor discharging opening 18 which is positioned along a distribution path 19 (see also FIG. 9A).

Each powder channel 16 comprises a channel receiving opening 20. The channel receiving openings 20 are positioned along the distribution path 19 (see also FIG. 9A) and directed towards the distributor discharging opening 18 to receive powder 4 discharged from the distributor discharging opening 18.

The packaging system 1 comprises a distribution drive 21 (see also FIG. 3) configured to move the distributor discharging opening 18 and the channel receiving openings 20 relative to each other with a cyclical movement 22 along the distribution path 19 to supply powder 4 from the powder distributor 17 to the powder channels 16.

FIG. 6A shows an enlarged view of section VI-A of FIG. 5, wherein the powder dispensers 9 are closed. FIG. 6B shows the view of FIG. 6A, wherein the powder dispensers 9 are open in order to fill the compartments 7 in the foil 3 with powder 4.

Each powder channel 16 is in fluid communication with only one powder dispenser 9 and each powder dispenser 9 is in fluid communication with only one of the powder channels 16.

The powder filling device 13 is configured to simultaneously discharge the powder 4 from the powder dispensers 9 in order to fill multiple compartments 7 in the foil 3 at the same time.

The cyclical movement 22 along the distribution path 19 of the distributor discharging opening 18 and the channel receiving openings 20 relative to each other to supply powder 4 from the powder distributor 17 to the powder channels 16 will be further discussed in detail with reference to the FIGS. 7-11.

In the embodiment of the powder distribution unit 15 shown in the FIGS. 3-11, the distribution drive 21 is configured to move the powder distributor 17 in order to create the cyclical movement 22 of the distributor discharging opening 18 and the channel receiving openings 20 relative to each other. In this embodiment, the powder channels 20 are not actively moved.

It will be clear for the skilled person that kinematic inversions are possible. In other examples of the powder distribution unit 15, the distribution drive 21 is configured to move the powder channels 16 in order to create said cyclical movement 22 of the powder distributor discharging opening 18 and the channel receiving openings 20 relative to each other. In this example, the powder distributor 17 is not actively moved.

In yet another example, the distribution drive 21 is configured to move the powder distributor 17 and the powder channels 16 in order to create said cyclical movement 22 of the distributor discharging opening 18 and the channel receiving openings 20 relative to each other.

As indicated in FIG. 7A, the distribution drive 21 is configured to move the distributor discharging opening 18 of the powder distributor 17 along a distributor trajectory 36 extending parallel to the distribution path 19.

In the above mentioned examples wherein the powder channels 16 are (also) moved, the distribution drive 21 is configured to move distributor discharging opening 18 of the powder distributor 17 along a channel trajectory extending parallel to the distribution path 19.

Turning back to FIG. 7A, the distribution path 19 is an open-ended path 41, more specifically a straight path 42. The cyclical movement 22 is a cyclical back and forth movement as indicated by the FIGS. 7A-11A.

The distribution path 19 extends between a first end position 44 and a second end position 45. The distributor discharging opening 18 is free from fluid communication with any of the channel receiving openings 20 when the distributor discharging opening 18 is positioned at the first end position 44 (see FIG. 7A) and the second end position 45 (see FIG. 10A).

The cyclical movement 22 starts at the first end position 44 as shown in FIG. 7A. The distributor discharging opening 18 is moved in the direction of arrow 90. This movement is further shown in the FIGS. 8A, 9A, and 10A. The distributor discharging opening 18 has reached the second end position 45 in FIG. 11A. After that, the distributor discharging opening 18 is moved in the opposite direction indicated by arrow 91 in order to return to first end position 44. This cycle is repeated in order to create the cyclical movement 22 of the distributor discharging opening 18 and the channel receiving openings 20 relative to each other.

The distribution drive 21 together with the first end position 44 and the second end position 45 are configured to allow the powder distributor 17 to accelerate in order to move the distributor discharging opening 18 and the channel receiving openings 20 relative to each other at a constant speed. The distributor discharging opening 18 passes each of the channel receiving openings 20 at the constant speed during said cyclical movement 22 of the distributor discharging opening 18 and the channel receiving openings 20 relative to each other. Hence, the distributor discharging opening 18 passes all the channel receiving openings 20 at the same constant speed during said cyclical movement 22. Each of these aspects facilitates a more equal distribution of the powder in the channel receiving openings 20.

The powder distributor 17 supplies powder to each of the powder channels 16 during said cyclical movement. The powder distributor 17 supplies powder to all the powder channels 16 during said cyclical movement.

The distributor discharging opening 18 passes each of the channel receiving openings 20 during said cyclical movement. The distributor discharging opening 18 passes all the channel receiving openings 20 during said cyclical movement.

The distributor discharging opening 18 overlaps each of the channel receiving openings 20 during said cyclical movement. The distributor discharging opening 18 overlaps all the channel receiving openings 20 during said cyclical movement.

The distribution path 19 comprises two parking sections 46 which are free from channel receiving openings 20 to allow parking of the powder distributor 17 without discharging powder 4 in any of the channel receiving openings 20. In the shown embodiment, the parking sections 46 are formed at the first end position 44 and the second end position 45. The parking sections 46 comprise a stop surface 48 configured to stop powder 4 flow from the distributor discharging opening 18.

In the alternative embodiment shown in FIG. 7C, the parking sections 46 comprise a powder collecting unit 47 configured to collect powder 4 discharged by the powder distributor 17.

As indicated in the FIGS. 9A and 9B, the distributor discharging opening 18 and the channel receiving openings 20 are configured to overlap along an associated first overlap line 23 extending in a first direction 24 perpendicular to the distribution path 19 in a same manner for each channel receiving opening 20 during said cyclical movement 22 of the distributor discharging opening 18 and the channel receiving openings 20 relative to each other. Due the segregation of the particles in the stream of powder flowing through the powder supply 14 and the distributor 17, the composition of the particles discharged by the distributor discharging opening 18 may differ in the first direction 24. By ensuring that the distributor discharging opening 18 and the channel receiving openings 20 overlap along the associated first overlap line 23 extending in the first direction 24 in the same manner for each channel receiving opening 20, the channel receiving openings 20 receive the same composition of particles.

Each of the following further specifications of the overlap between the distributor discharging opening 18 and the channel receiving openings 20 contributes to further reducing the degree of differences in the composition of the particles of the powder supplied via the distributor discharging opening 18 to the channel receiving openings 20.

Each first overlap line 23 has a same first overlap length 25. The first overlap line 23 for each channel receiving opening 20 has a same first overlap position 29 in the first direction 24 with respect to the distribution path 19.

The overlapping along the associated first overlap line 23 for each channel receiving opening 20 is determined in a first situation 27 of maximum overlap along the first overlap line 23 between the distributor discharging opening 18 and the respective channel receiving opening 20, wherein the first overlap line 23 has a maximum first overlap length 25 in said first situation 27.

Each channel receiving opening 20 extends over a channel length 28 in the first direction 24 and the channel lengths 28 of all the channel receiving openings 20 are equal to each other. Each channel receiving opening 20 has a same channel position 29 in the first direction 24 with respect to the distribution path 19.

The distributor discharging opening 18 and each of the channel receiving openings 20 are configured to overlap along an associated second overlap line 30 extending in a second direction 31 along the distribution path 19 in a same manner for each channel receiving opening 20 during said cyclical movement 22 of the distributor discharging opening 18 and the channel receiving openings 20 relative to each other. Each second overlap line 30 has a same second overlap length 32.

The overlapping in the second direction 31 for each channel receiving opening 20 is determined in a second situation 33 of maximum overlap along the second overlap line 30 between the distributor discharging opening 18 and the respective channel receiving opening 20, wherein the second overlap line 30 has a maximum second overlap length 32 in said second situation 33. The second situation 33 is equal to the first situation 27.

Each channel receiving opening 20 extends over a channel width 34 in the second direction 31 and the channel widths 34 of all the channel receiving openings 20 are equal to each other.

Each channel receiving opening 20 has a receiving shape 35, wherein the receiving shapes 35 of all channel receiving openings 20 are equal to each other.

The FIGS. 12-15 shown another alternative embodiment of the powder distribution unit 15 according to the invention. The distribution path 19 is a closed path 38, more specifically a circular path 39 (see FIG. 14A).

In FIG. 12A, the distributor discharging opening 18 is positioned at a parking section 46 provided with a stop surface 48. The FIGS. 13A, 14A, and 15A show how the distributor discharging opening 18 moves with respect to the channel receiving openings 20. The shown movement continues and a cycle is completed when the distributor discharging opening 18 reaches the parking section 46 again. The cyclical movement of the distributor discharging opening 18 is a cyclical continuous movement indicated by arrow 22. The distributor discharging opening 18 is moved in the direction of arrow 22 at a constant speed. The distribution drive 21 is configured to move the distributor discharging opening 18 and the channel receiving openings 20 relative to each other during the continuous movement. The distributor discharging opening 18 passes each of the channel receiving openings 20 during the continuous movement. Hence, the distributor discharging opening 18 passes all of the channel receiving openings 20 during the continuous movement. In another example, the cyclical movement is a cyclical back and forth movement which starts and ends at the parking section.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

It will be apparent to those skilled in the art that various modifications can be made to the packaging system and the method without departing from the scope as defined in the claims.

The invention claimed is:

1. The packaging system for producing pouches comprising a water-soluble foil and a powder, the packaging system comprising:

multiple moulds, each mould having a mould cavity for forming a compartment in the foil, and a mould conveyor configured to move the moulds in a conveying direction along a mould trajectory, such as an endless mould trajectory, and wherein the moulds are moved along:

a foil supplying device configured to position the foil on the moulds, a compartment forming device configured to position parts of the foil in the mould cavities to form the compartments in the foil, a powder filling device comprising multiple powder dispensers configured to fill the compartments with the powder, and wherein the powder filling device comprises a powder supply for supplying the powder to a powder distribution unit which distributes the powder over multiple powder channels which are in fluid communication with the powder dispensers, the powder distribution unit comprises a powder distributor comprising a distributor discharging opening which is positioned along a distribution path, each powder channel comprises a channel receiving opening, the channel receiving openings are positioned along the distribution path and directed towards the distributor discharging opening to receive powder discharged from the distributor discharging opening, and the packaging system comprises a distribution drive configured to move the distributor discharging opening and the channel receiving openings relative to each other with a cyclical movement along the distribution path to supply powder from the powder distributor to the powder channels such that the distributor discharging opening passes each of the channel receiving openings at a constant speed during said cyclical movement of the distributor discharging opening and the channel receiving openings relative to each other.

2. The packaging system according to claim 1, wherein the distributor discharging opening and the channel receiving openings are configured to overlap along an associated first overlap line extending in a first direction perpendicular to the distribution path in a same manner for each channel receiving opening during said cyclical movement of the distributor discharging opening and the channel receiving openings relative to each other.

3. The packaging system according to claim 2, wherein each first overlap line has a same first overlap length.

4. The packaging system according to claim 2, wherein said first overlap line for each channel receiving opening has a same first overlap position in the first direction with respect to the distribution path.

5. The packaging system according to claim 2, wherein said overlapping along the associated first overlap line for each channel receiving opening is determined in a first situation of maximum overlap along the first overlap line between the distributor discharging opening and the respective channel receiving opening, wherein the first overlap line has a maximum first overlap length in said first situation.

6. The packaging system according to claim 1, wherein the distributor discharging opening and each of the channel receiving openings are configured to overlap along an associated second overlap line extending in a second direction along the distribution path in a same manner for each channel receiving opening during said cyclical movement of the distributor discharging opening and the channel receiving openings relative to each other.

7. The packaging system according to claim 6, wherein each second overlap line has a same second overlap length.

8. The packaging system according to claim 6, wherein said overlapping in the second direction for each channel receiving opening is determined in a second situation of maximum overlap along the second overlap line between the distributor discharging opening and the respective channel receiving opening, wherein the second overlap line has a maximum second overlap length in said second situation.

9. The packaging system according to claim 6, wherein each channel receiving opening extends over a channel width in the second direction and the channel widths of all the channel receiving openings are equal to each other.

10. The packaging system according to claim 1, wherein the distribution drive is configured to move the distributor discharging opening and the channel receiving openings relative to each other at a constant speed.

11. The packaging system according to claim 1, wherein:

the distribution drive is configured to move the powder distributor in order to create said cyclical movement of the distributor discharging opening and the channel receiving openings relative to each other, or the distribution drive is configured to move the powder channels in order to create said cyclical movement of the distributor discharging opening and the channel receiving openings relative to each other, or the distribution drive is configured to move the powder distributor and the powder channels in order to create said cyclical movement of the distributor discharging opening and the channel receiving openings relative to each other.

12. The packaging system according to claim 1, wherein the distribution path is a closed path, such as a circular path, and wherein optionally the cyclical movement is a cyclical continuous movement or a cyclical back and forth movement.

13. The packaging system according to claim 1, wherein the distribution path is an open-ended path, such as a straight path, and wherein optionally the cyclical movement is a cyclical back and forth movement.

14. The packaging system according to claim 13, wherein the distribution path extends between a first end position and a second end position, wherein the distributor discharging opening is free from fluid communication with any of the channel receiving openings when the distributor discharging opening is positioned at the first end position and/or the second end position.

15. The packaging system according to claim 1, wherein the distribution path comprises at least one parking section which is free from channel receiving openings to allow parking of the powder distributor without discharging powder in any of the channel receiving openings.

16. The packaging system according to claim 1, the powder distributor supplies powder to all the powder channels during the cyclical movement of the distributor discharging opening and the channel receiving openings relative to each other.

17. The packaging system according to claim 1, the powder distributor supplies powder to each of the powder channels during the cyclical movement of the distributor discharging opening and the channel receiving openings relative to each other.

18. The packaging system according to claim 1, wherein each powder channel is in fluid communication with only one powder dispenser and each powder dispenser is in fluid communication with only one of the powder channels.

19. The packaging system according to claim 1, wherein the packaging system comprises a further foil supplying device configured to position a water-soluble further foil on the foil and over the powder in the compartments in order to form a web of pouches holding the powder between the foil and the further foil.

20. A method for producing pouches comprising a water-soluble foil and powder with the packaging system according to claim 1, said method comprising moving the distributor discharging opening of the powder distributor and the channel receiving openings of the powder channels relative to each other with a cyclical movement along the distribution path to supply powder from the powder distributor to the powder channels, wherein:

the distributor discharging opening passes each of the channel receiving openings at a constant speed during said cyclical movement of the distributor discharging opening and the channel receiving openings relative to each other, and the powder distributor supplies powder to each of the powder channels during said cyclical movement of the distributor discharging opening and the channel receiving openings.

* * * * *